US008061545B2

(12) United States Patent
Roth et al.

(10) Patent No.: US 8,061,545 B2
(45) Date of Patent: Nov. 22, 2011

(54) TWO PART CONTAINER ADAPTED TO SEPARATELY HOLD CONSUMABLE FOODSTUFFS

(75) Inventors: Donna Roth, Plymouth, MA (US); Henry Roth, Plymouth, MA (US)

(73) Assignee: Cool Gear International, LLC, Jenkintown, PA (US)

( * ) Notice: Subject to any disclaimer, the term of this patent is extended or adjusted under 35 U.S.C. 154(b) by 1066 days.

(21) Appl. No.: 11/247,859

(22) Filed: Oct. 11, 2005

(65) Prior Publication Data

US 2006/0086756 A1 Apr. 27, 2006

Related U.S. Application Data

(63) Continuation-in-part of application No. 11/012,452, filed on Dec. 15, 2004, which is a continuation-in-part of application No. 29/217,503, filed on Nov. 18, 2004, now Pat. No. Des. 536,579, and a continuation-in-part of application No. 29/214,964, filed on Oct. 12, 2004, now Pat. No. Des. 537,682.

(51) Int. Cl.
*B65D 81/36* (2006.01)

(52) U.S. Cl. ..... 220/23.4; 206/541; 206/217; 220/23.83

(58) Field of Classification Search ..... 206/541, 206/542, 217, 218; 215/6, 10, 386; 220/23.2, 220/23.4, 23.83, 23.86
See application file for complete search history.

(56) References Cited

U.S. PATENT DOCUMENTS

| | | | | |
|---|---|---|---|---|
| 2,604,089 | A * | 7/1952 | Peyser | 126/262 |
| 4,324,338 | A * | 4/1982 | Beall | 215/6 |
| 4,624,383 | A * | 11/1986 | Moore | 220/23.6 |
| 4,632,273 | A * | 12/1986 | Rhine | 206/217 |
| 4,756,424 | A * | 7/1988 | Schwartz | 206/542 |
| 4,928,848 | A * | 5/1990 | Ballway | 220/23.87 |
| 5,154,303 | A * | 10/1992 | Jordan | 220/23.86 |
| 5,318,787 | A * | 6/1994 | Brauner et al. | 426/120 |
| 5,417,327 | A * | 5/1995 | Saumure | 206/427 |
| 5,429,262 | A * | 7/1995 | Sharkey | 220/23.83 |
| 5,531,353 | A * | 7/1996 | Ward et al. | 220/729 |
| 5,630,523 | A * | 5/1997 | Wright | 220/23.83 |
| 5,642,831 | A * | 7/1997 | Lynd | 220/8 |
| 5,664,671 | A * | 9/1997 | Nedblake, Jr. | 206/217 |
| 5,705,212 | A * | 1/1998 | Atkinson | 426/115 |
| 5,715,969 | A * | 2/1998 | Seerup et al. | 220/503 |
| 5,938,053 | A * | 8/1999 | Verbovszky et al. | 215/6 |
| 5,954,213 | A * | 9/1999 | Gerhart et al. | 215/10 |
| 6,116,439 | A * | 9/2000 | Yaniv | 215/11.1 |
| 6,371,324 | B1 * | 4/2002 | Torniainen et al. | 220/212 |
| 6,382,411 | B1 * | 5/2002 | Wentling | 206/217 |
| 2002/0074334 | A1 * | 6/2002 | Karp | 220/212 |
| 2003/0052018 | A1 * | 3/2003 | Wilson | 206/217 |

* cited by examiner

*Primary Examiner* — J. Gregory Pickett
*Assistant Examiner* — Andrew Perreault
(74) *Attorney, Agent, or Firm* — Edwards Wildman Palmer LLP; Steven M. Jensen; Brian R. Landry

(57) ABSTRACT

A two part container adapted to separately hold consumable foodstuffs. The two part container provides a convenient device for transporting different foodstuffs in a separated fashion using a single container.

24 Claims, 14 Drawing Sheets

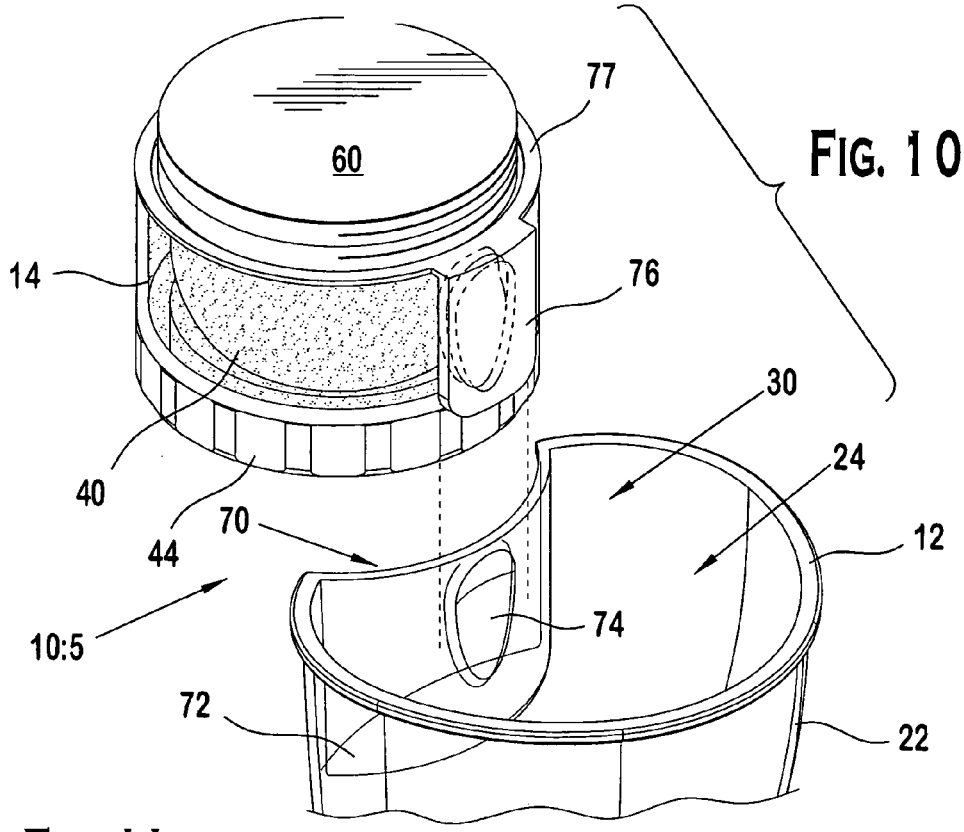
FIG. 10
FIG. 11
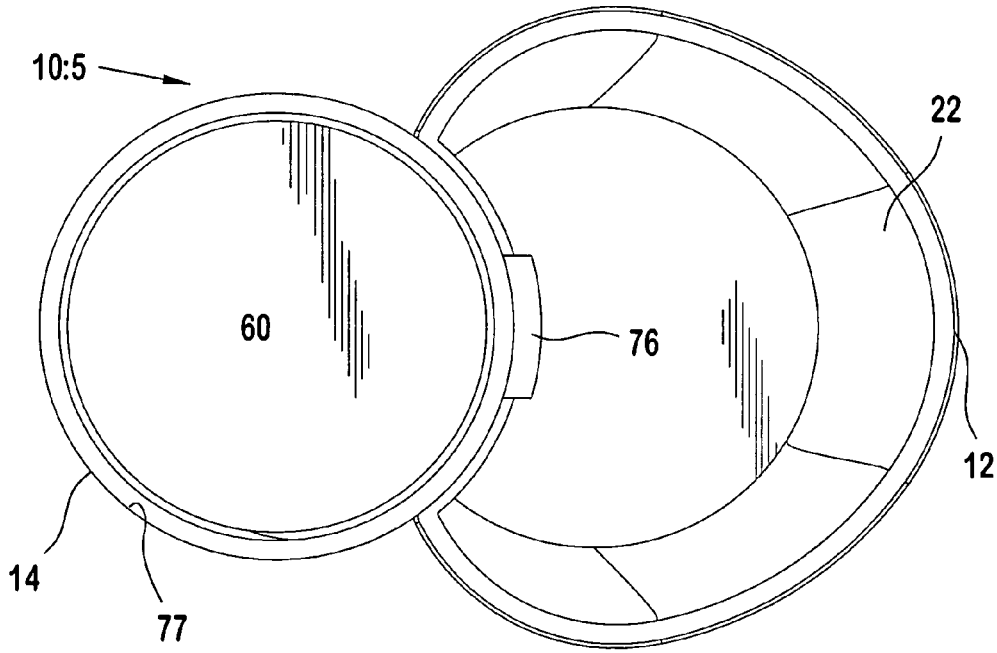

TWO PART CONTAINER ADAPTED TO SEPARATELY HOLD CONSUMABLE FOODSTUFFS

CROSS REFERENCE TO RELATED APPLICATIONS

This application is a continuation-in-part of an claims priority to U.S. patent application Ser. No. 11/012,452, filed Dec. 15, 2004, which is a continuation-in-part of and claims priority to: U.S. Design Patent Application 29/214,964, filed Oct. 12, 2004; and U.S. Design Patent Application 29/217,503, filed Nov. 18, 2004; each of the above patent applications is hereby incorporated by reference herein in its entirety as if fully set forth.

BACKGROUND

The present invention is generally directed to foodstuff containers and, more specifically, is directed to a two part container adapted to separately hold consumable foodstuff.

Typically, when a liquid foodstuff, such as soda, and a solid foodstuff, such as grapes, are transported to school or work for later consumption, they are transported in separate containers. This often requires that a bag or knapsack be used to carry the multiple containers necessary to transport the desired foodstuffs. When the containers are carried by hand, carrying the various containers can be unwieldy for adults and difficult for children. Additionally, when a child remains home after adults have left and the child is responsible for organizing prepared foods to take with her or him, a child will often forget part of a snack or meal.

It would be advantageous to provide a two part container adapted to separately hold consumable foodstuffs which can either be beverages or food; preferably, at least one of the container parts includes thermal energy storage material to allow the consumable foodstuff in that container part to be chilled or heated.

SUMMARY

Briefly speaking, one embodiment of the present invention is directed to a two part container adapted to separately hold consumable foodstuffs including a first container having a first container base. A first container sidewall extends from the first container base to define a first container mouth. The first container sidewall and the first container base define a first foodstuff receiving cavity. A second container includes a second container base. A second container sidewall extends from the base to define a second container mouth. The second container sidewall is formed by inner and outer panels. The inner panel and the second container base define a second foodstuff receiving cavity. The outer panel is spaced from the inner panel to define a chamber therebetween. Thermal energy storage material is located in the chamber. Wherein the first and second containers are detachably engageable in first and second positions. When the first and second containers are detachably engaged in the first position, the first and second containers are located end-to-end with the first and second container bases in a generally facing orientation to form the two part container. When the first and second containers are detachably engaged in the second position, the first and second container mouths are located generally side-by-side.

In another aspect, the present invention is directed to a two part container adapted to separately hold consumable foodstuffs including a first container having a first container base.

A first container sidewall extends from the first container base to define a first container mouth. The first container sidewall and the first container base define a first foodstuff receiving cavity. A second container includes a second container base. A second container sidewall extends from the base to define a second container mouth. The second container base and the second container sidewall define a second foodstuff receiving cavity. Wherein the first and second containers are detachably engageable in first and second positions. When the first and second containers are detachably engaged in the first position, the first and second containers are located end-to-end with the first and second container bases in a generally facing orientation to form the two part container. When the first and second containers are detachably engaged in the second position, the first and second container mouths are located generally side-by-side.

In another aspect, the present invention is directed to a two part container adapted to separately hold consumable foodstuffs including a first container having a first container base. A first container sidewall extends from the first container base to define a first container mouth. The first container sidewall and the first container base define a first foodstuff receiving cavity. Wherein the first container sidewall defines a recess proximate to the first container mouth. The recess forms a shoulder. A second container includes a second container base. A second container sidewall extends from the base to define a second container mouth. The second container base and the second container sidewall define a second foodstuff receiving cavity. A clip is positioned on the second container. Wherein the first and second containers are detachably engageable in first and second positions. When the first and second containers are detachably engaged in the first position, the first and second containers are located end-to-end. When the first and second containers are detachably engaged in the second position, the first and second container mouths are located generally side-by-side and the clip is engaged with the first container sidewall and the second container is partially located on the shoulder of the first container.

BRIEF DESCRIPTION OF THE DRAWINGS

The foregoing summary, as well as the following description of the preferred embodiments of the present invention, will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings:

FIG. 10 is a partial perspective view of the two part container of FIG. 7 illustrating the second container about to be lowered into engagement with the first container;

FIG. 11 is a top plan view of the two part container of FIG. 7 with the first and second containers engaged in the second position;

FIG. 13 is an enlarged, cross-sectional view of the two part container of FIG. 8 as taken along the line 13-13 in FIG. 8; it is preferred that the second container base is threadably connected to the base of the first container when the two part container is in the first position; the first and second containers can be connected by a snap fit, fasteners, or the like;

FIG. 15 is a partial, perspective view of a sixth preferred embodiment of the two part container of the present invention illustrating at least one strap securing the second container to the first container; the strap can be secured using a buckle, hook and loop material, snaps, or the like;

DETAILED DESCRIPTION OF THE PREFERRED EMBODIMENT(S)

Figure 1:
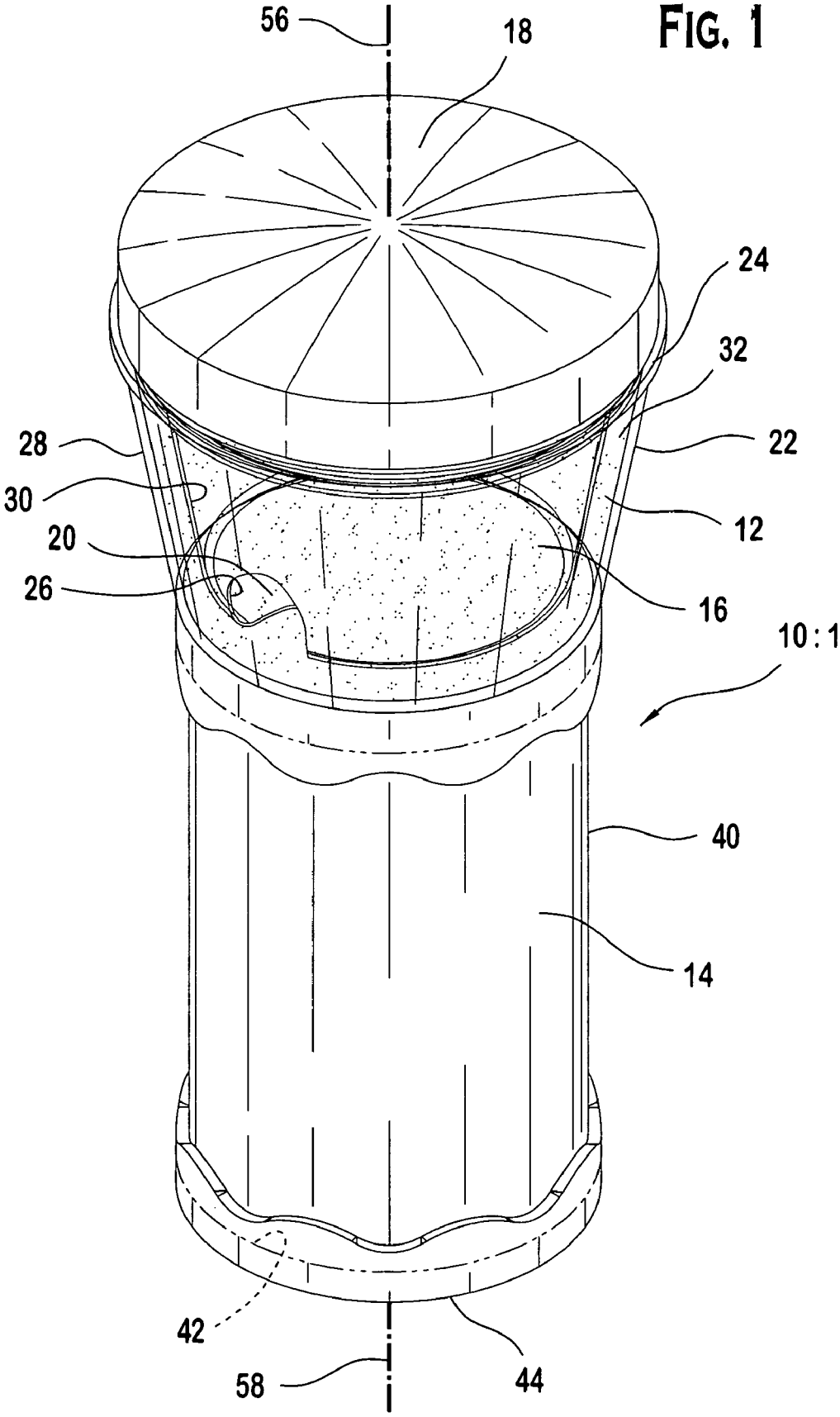
FIG. 1 is a perspective partially broken away view of a first preferred embodiment of the two part container of the present invention; the broken away section makes clearer the first container base 20 and the inner panel 26; the two part container includes a first container having thermal energy storage material therein; the two part container can include thermal energy storage material in the first container and/or in the second container to allow one or both of the first and second containers to be heated and/or chilled.

Certain terminology is used in the following description for convenience only is not limiting. The words "right," "left," "top," and "bottom" designate directions in the drawings to which reference is made. The words "inwardly" and "outwardly" refer to directions toward and away from, respectively, the geometric center of the two part container and designated parts thereof. The word "foodstuff", as used in the claims and in the corresponding portions of the specification, is defined as including "one or both of liquid foods (such as milk, water, Gatorade, soda or the like) and solid foods (such as cookies, cereal, sandwiches, egg salad, or the like)." The words "a" and "one" are defined as including one or more of the referenced item unless specifically stated otherwise. This terminology includes the words above specifically mentioned, derivatives thereof, and words of similar import.

Referring to FIGS. 1-18, wherein like numerals indicate like elements throughout, nine preferred embodiments of a two part container are shown and designated 10:1-10:9, respectively. Briefly stated, the two part container 10:1-10:9 provides an improved container for transporting separated foodstuffs. The two part container 10:1-10:9 is preferably also able to keep foodstuffs therein chilled or heated as desired.

While the top container part shown in the drawings is referred to as the first container 12 and the bottom container part shown in the drawings is referred to as the second container 14, such designations are for convenience only. It is understood by those of ordinary skill in the art from this disclosure, that the terms first and second container 12, 14 as used in the claims can each refer to either one of the container parts shown in the drawings. That is, the claimed "second container" may refer to either the top or bottom container part shown in the drawings (while the claimed "first container" refers to the remaining container part shown in the drawings) without departing from the scope of the present invention.

The first and second containers 12, 14 are preferably made of a polymeric material, such as polyethylene, polyethylene terephthalate (PET), polyvinyl chloride (PVC), polyphthalate carbonate (PPC) or any other suitable material. The first and second containers 12, 14 preferably have generally circular cross-sections. However, referring to FIGS. 7-18, the first and second containers can have varying and/or irregular cross-sectional areas without departing from the scope of the present invention.

Referring to FIG. 1, a first preferred embodiment of the two part container 10:1 is shown. The two part container 10:1 is adapted to separately hold consumable foodstuffs. The top portion of the two part container 10:1 is formed by a first container 12 that preferably flares generally outwardly from the second container 14 in a conical fashion. The first container 12 includes a first container base 20 which preferably has a generally circular shape. A first container sidewall 22 extends from the base 20 to define a first container mouth 24. The first container sidewall 22 may be formed by inner and outer panels 26, 28. The inner and outer panels 26, 28 may be translucent or opaque, as desired.

The inner panel 26 and the first container base 20 define a first foodstuff receiving cavity 30. The outer panel 28 is generally coextensive with and spaced from the inner panel 26 to define a chamber 32 therebetween.

It is preferred that a first diameter 34 of the first container mouth 24 is greater than a second diameter 36 of the first container base 20. It is also preferred that the outer panel 28 of the first container 12 is generally translucent so that the first container 12 generally has the color of the thermal energy storage material 16 located in the chamber 32. The thermal energy storage material 16 is preferably any suitable freezable and/or reheatable material, such as a refreezeable gel or the like. It is preferred that the gel can undergo repeated cycles of freezing and thawing in order to provide cooling. Heat storing materials may also be utilized such that the thermal energy storage material can be placed in a microwave oven to allow the thermal energy storage material 16 to provide warmth to foodstuffs.

Figure 2:
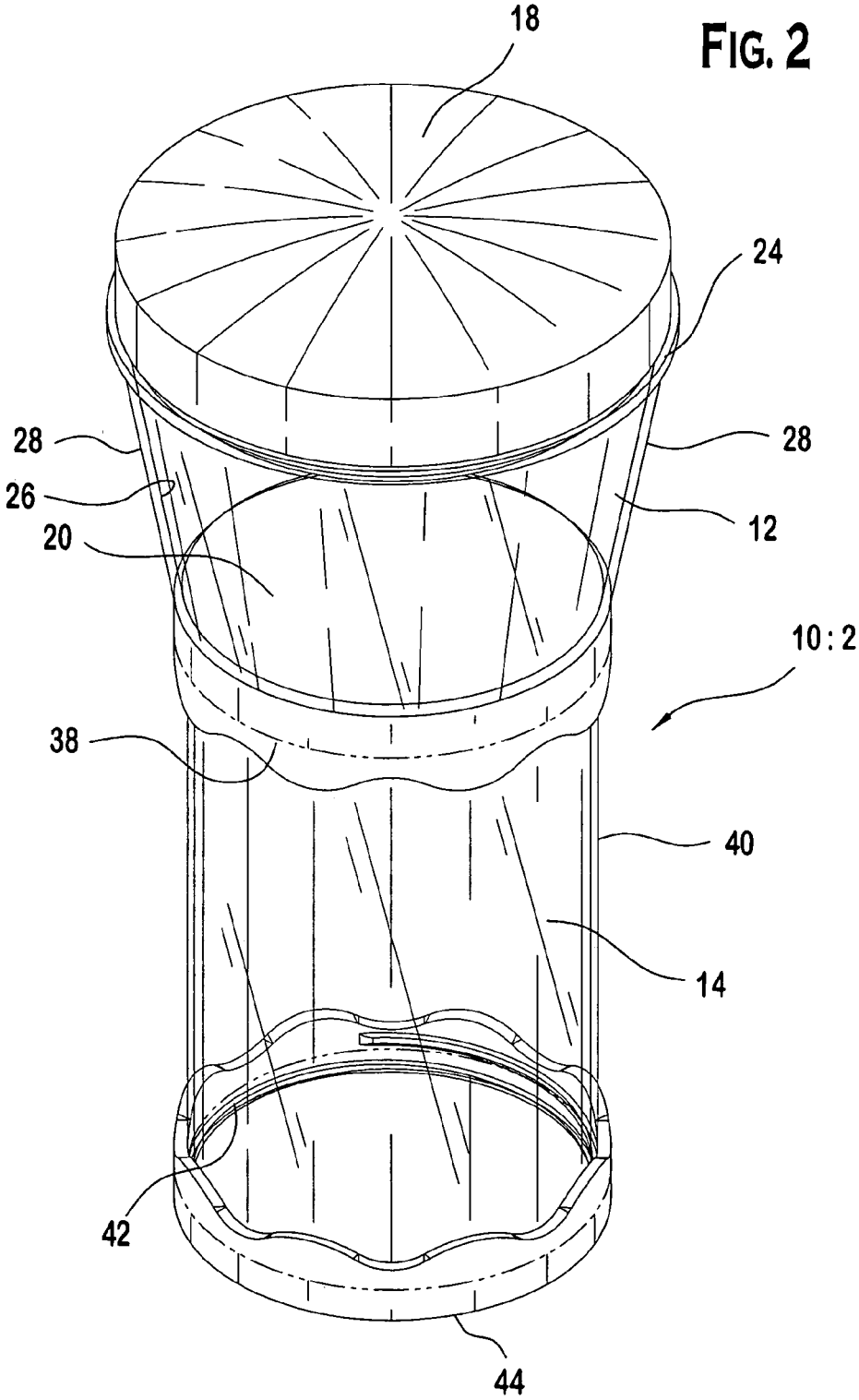
FIG. 2 is a perspective view of a second preferred embodiment of the two part container of the present invention; the two part container is preferably formed of generally translucent material which can have paper inserts placed therein or therearound to add a desired design.
Figure 3:
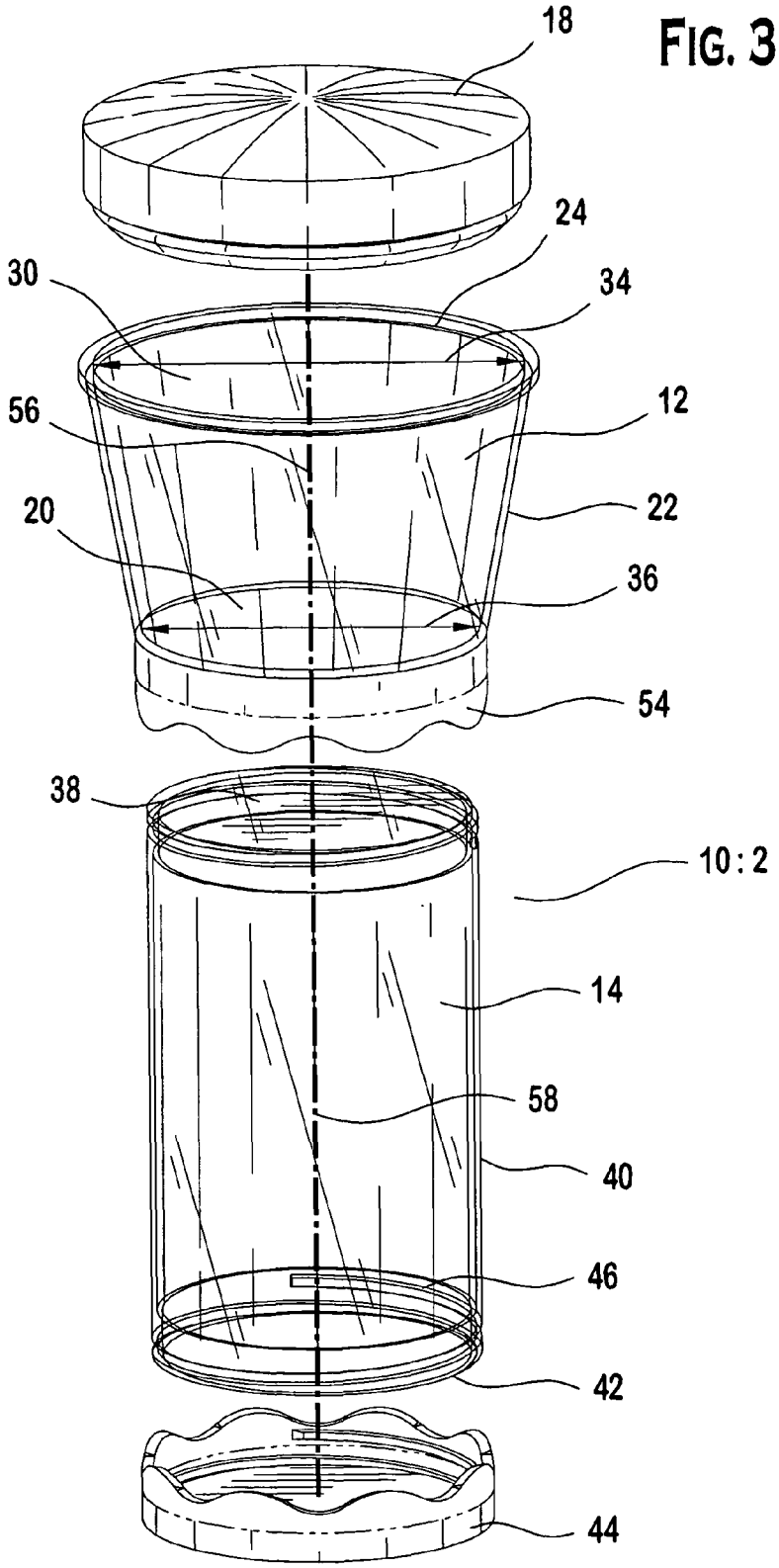
FIG. 3 is an exploded view of the two part container of FIG. 2.

Referring to the first and second embodiments of the two part container 10:1, 10:2 shown in FIGS. 1-3, the two part container 10:1, 10:2 includes a second container 14. The second container 14 preferably has a generally elongated tubular shape. The second container 14 includes a second container base 38. It is preferred that the second container base 38 is generally circular. A second container sidewall 40 extends from the second container base 38 to define a second container mouth 42. Referring specifically to FIG. 3, it is preferable that an end cap 44 form a lid for the second container mouth 42. The end cap 44 is preferably secured to the second container 14 via a threaded connection 46. However, any known means for securing the end cap 44 to the second container 14 can be used without departing from the present invention. For example, the end cap 44 can be secured to the second container 14 via a twist lock mechanism, a snap fit mechanism or the like. While the end cap 44 is shown as a solid lid, those of ordinary skill in the art will appreciate from this disclosure that the end cap 44 can be formed from a drinking lid that incorporates a spout or other mechanism for drinking therefrom.

The second container sidewall 40 and the second container base 38 define a second foodstuff receiving cavity 48. Referring to the fourth embodiment of the two part container 10:4 shown in FIG. 6, it is preferable that a third diameter 50 of the second container mouth 42 is greater than a fourth diameter 52 of the second container base 38.

Figure 4:
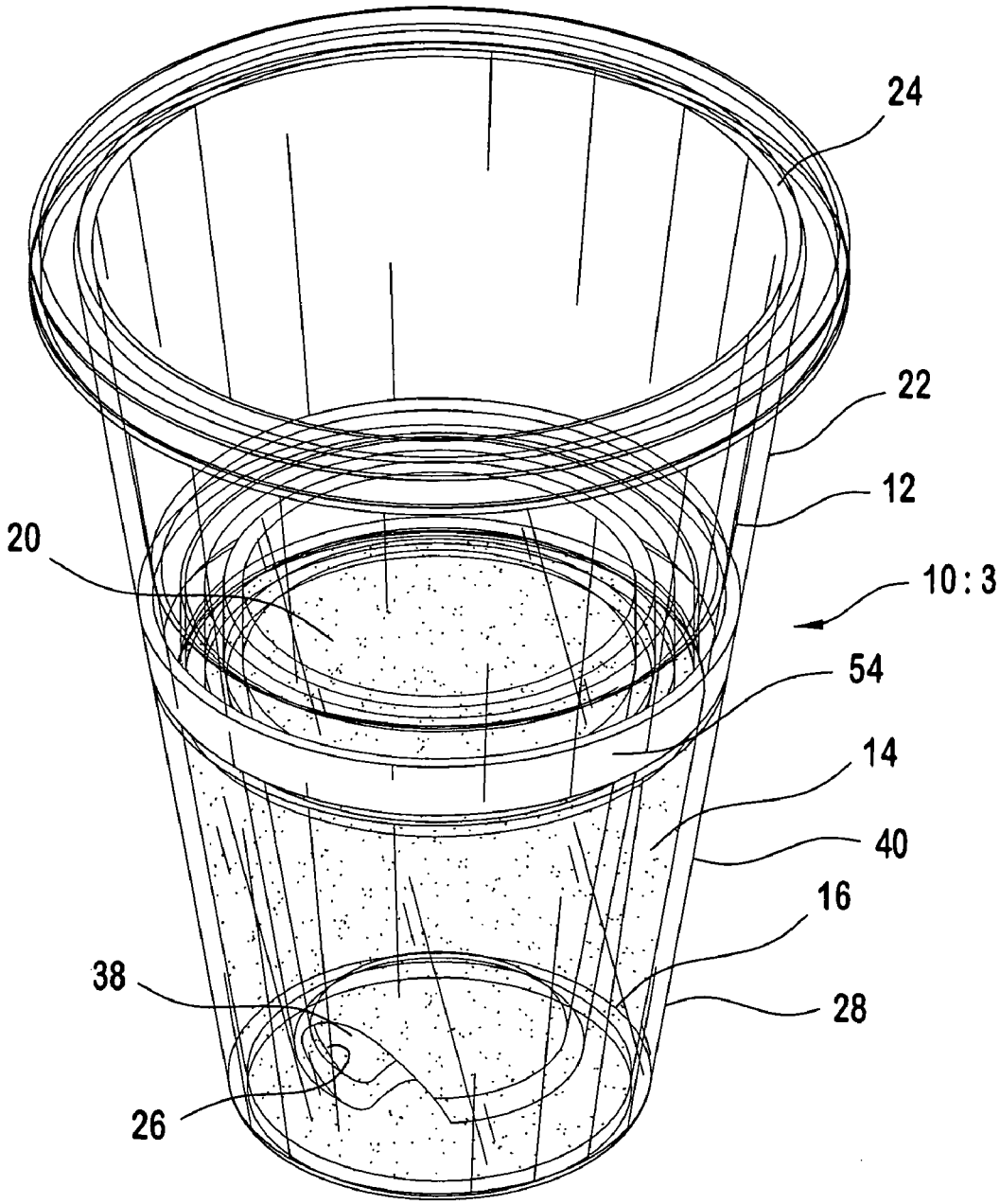
FIG. 4 is a perspective partially broken away view of a third preferred embodiment of the two part container of the present invention; the broken away section makes clearer the second container base 38 and the inner panel 26; the second container includes thermal energy storage material for heating or cooling the contents therein; however, both the first and second containers can include thermal energy storage material or the thermal energy storage material can be omitted altogether without departing from the scope of the present invention; additionally, when thermal energy storage material is included in either of the first or second containers, the first or second containers may be formed of translucent material to allow the container to have the color of the associated thermal energy storage material.
Figure 5:
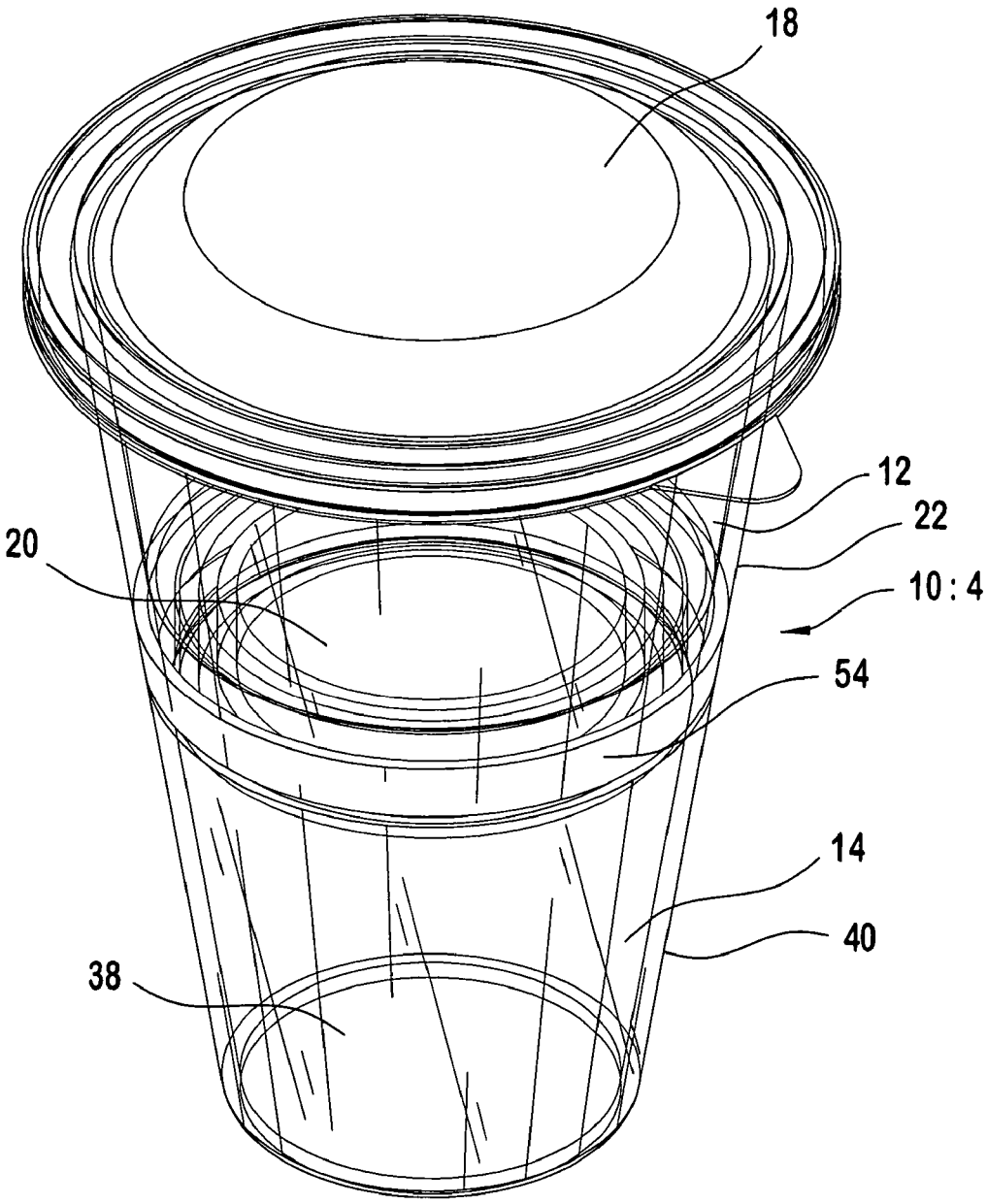
FIG. 5 is a perspective view of a fourth preferred embodiment of the two part container of the present invention; the two part container has translucent first and second containers and preferably does not use thermal energy storage material therein.
Figure 6:
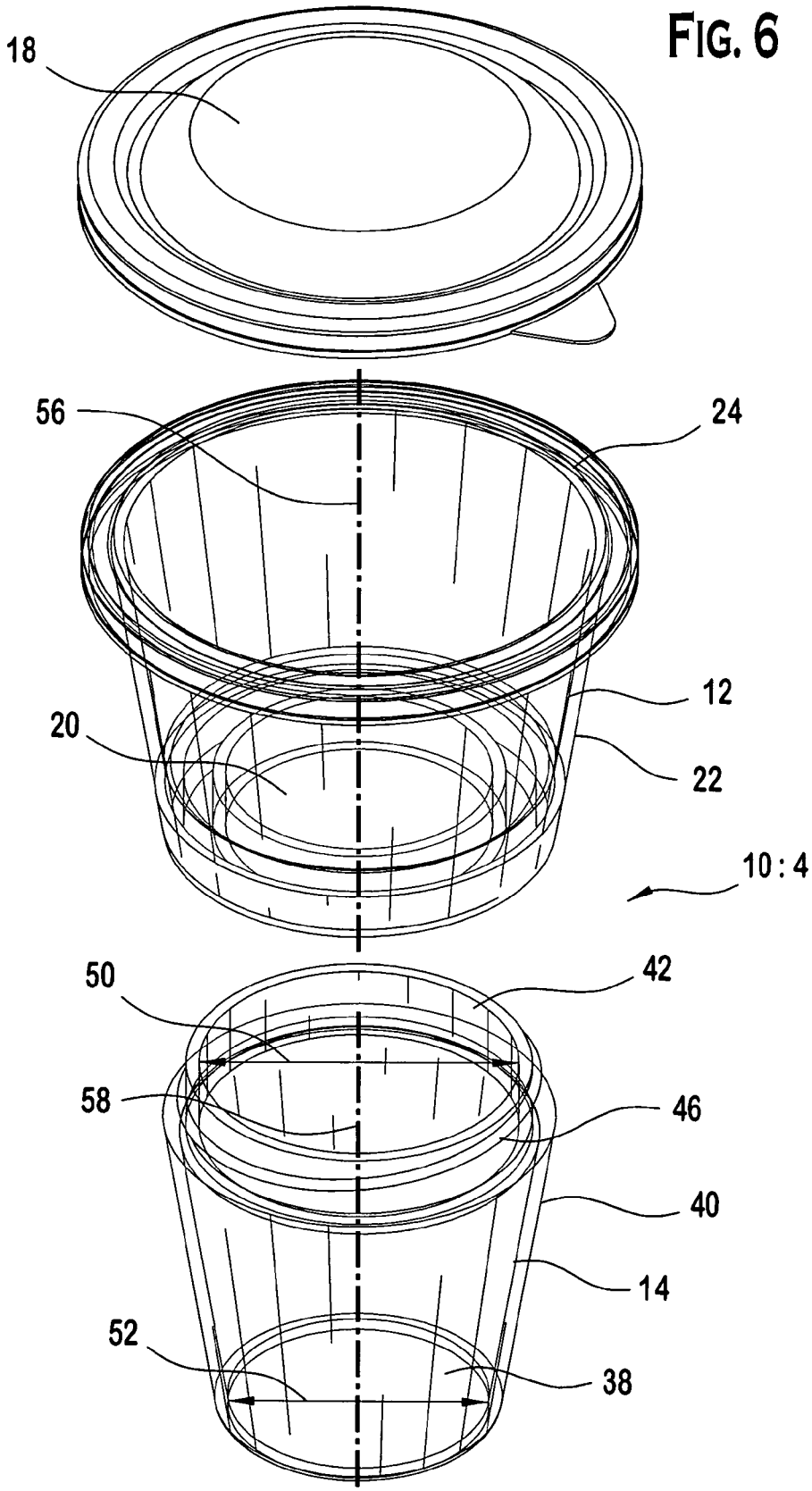
FIG. 6 is an exploded view of the two part container of FIG. 5.

Referring to the two part container 10:1, 10:2 of FIGS. 1-3, it is preferred, but not necessary, that the first and second container mouths 24, 42 are located on generally opposing sides of the two part container 10:1, 10:2 when the first and second containers 12, 14 are attached. However, as shown in FIGS. 4-6, the two part container 10:3, 10:4 may incorporate first and second containers 12, 14 that, when attached, result in the first container 12 providing a lid for the second container 14. Referring to FIGS. 1-3, the second container 14 may have a generally translucent sidewall.

The first and second containers 12, 14 are detachably engageable to form the two part container 10:1-10:4. Referring to FIG. 3, the first and second containers may be detachably engaged via a twist lock mechanism. Alternatively, referring to FIG. 6, the first and second containers 12, 14 may be detachably engageable via a threaded connection 46. Any known connection method can be used without departing from the present invention.

As best shown in FIG. 3, the two part container 10:1 may include a grip member 54 positioned approximate to an interface between the first and second containers 12, 14 and secured generally around the first container base 20 when the first and second containers 12, 14 are attached. This grip member 54 is preferably made of a soft rubber or other material suitable for easy gripping.

Referring to FIGS. 3 and 6, the first container 12 preferably has a first longitudinal axis 56 and the second container preferably has a second longitudinal axis 58. When the first and second containers 12, 14 are detachably engaged, it is preferred that the first and second axes are aligned to position the first and second containers 12, 14 in a generally end-to-end fashion. Referring to FIGS. 1-3, the two part container may be configured for convenient use with milk and cookies. For example, milk can be placed in the first container 12. As shown in FIG. 1, thermal energy storage material can be used to chill the milk prior to consumption. The circular second container 14 is ideal for storing cookies therein. It is preferred that the diameter of each of the cookies is generally the same as an interior diameter of the second container sidewall 40. While the second containers 14 of FIGS. 1-3 are shown as having an end cap 44 which seals a downwardly facing second container mouth 42, those of ordinary skill in the art will appreciate from this disclosure that the second container 14 can have a mouth 42 on an upper end that is sealed by the first container 12 without departing from the scope of the present invention.

Referring now to FIGS. 4-6, the two part container 10:3, 10:4 may be used for milk and cereal. For example, milk is preferably placed in the second container 14 (or may be placed in the second container 12) and thermal energy storage material 16 may be used to keep the milk cool until consumption. Cereal is then positioned in the remaining container part. A foldable spoon can be located in the cereal holding container part so that the consumption of an entire meal does not require carrying additional materials.

While specific types of foodstuffs have been discussed above, those of ordinary skill in the art will appreciate from this disclosure that any type of foodstuffs may be used with the first and second containers without departing from the scope of the present invention. Additionally, a handle or carry strap may be integrated with the two part container 10:1-10:4 without departing from the scope of the present invention.

While the illustrated embodiments of the two part container 10:1-10:9 are shown as being generally cylindrically shaped, those of ordinary skill in the art will appreciate from this disclosure, that the first and containers 12, 14 can have any cross-section without departing from the scope of the present invention. For example, the first and second containers 12, 14 may have a square, triangular, polygonal or a regularly shaped cross-section without departing from the scope of the present invention.

Referring to FIG. 1, one embodiment of the present invention operates as follows. The first container 12 is preferably refrigerated or frozen so that the thermal energy storage material 16 will provide cooling to any foodstuffs therein. Then, milk is poured in the first foodstuff receiving cavity 30 and a lid 18 is placed thereon. While the lid 18 is shown as a solid, flat lid, those of ordinary skill in the art will appreciate from this disclosure that the lid can be formed from a drinking lid that incorporates a spout or other mechanism for drinking therefrom.

The end cap 44 of the second container 14 is removed and cookies are sequentially slid inside the second container 14. Once the second container 14 holds the desired number of cookies, the end cap 14 is secured thereto. The bases 20, 38 of the first and second containers 12, 14 are detachably engaged to form a two part container 10:1.

Once cookies and milk are desired, the second container 14 is separated from the first container 12. The first container 12 is preferably placed on a flat surface, such as a table, and the lid 18 removed. Then, the end cap 44 of the second container 14 is removed so that one or more cookies can be slid out of the second container 14. The cookies can then be dunked in the milk or otherwise consumed therewith.

Referring to FIG. 4, another embodiment of the present invention preferably operates as follows, the second container 14 is preferably refrigerated or frozen so that thermal energy storage material 16 can provide cooling to foodstuffs therein. Then, milk is poured into the second container 14 and the second container 14 is sealed by detachably engaging the first container 12 thereover. Then, cereal is poured into the first container 12. It is preferable that a foldable spoon is placed on top of the cereal for convenience only. A lid 18 is then used to seal the first container 12.

Once consumption of cereal and milk is desired, the first container 12 is removed from the second container 14 and placed on a flat surface such as a table, and a lid 18 is removed therefrom. Then, any spoon or other utensil is removed from the first container 12 and the second container 14 is used to pour milk over the cereal in the first container 12.

Referring to FIGS. 7-14, a fifth preferred embodiment of the two part container 10:5 is shown. As with any of the two part containers of the present invention 10:1-10:9, the two part container 10:5 can have thermal energy storage material 16 in either the first and/or second container 12, 14 or not have any thermal energy storage material 16 therein without departing from the spirit of the present invention. That is, the two part container 10:5 of the present invention does not require the use of thermal energy storage material 16 to store foodstuffs 66.

Figure 7:
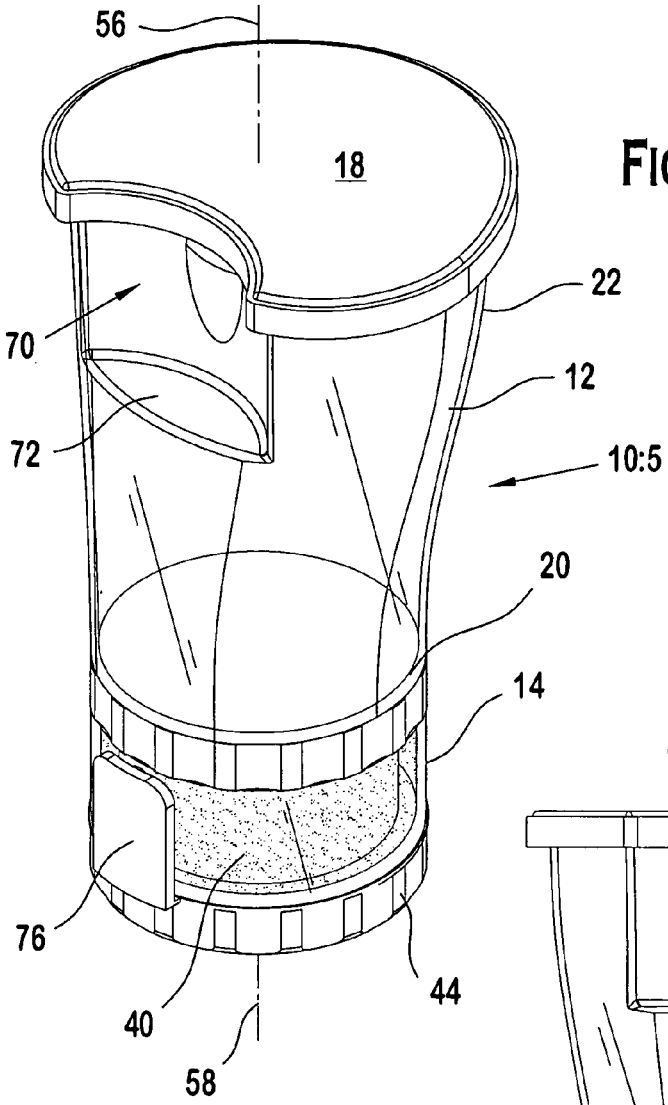
FIG. 7 is a perspective view of a fifth preferred embodiment of a two part container according to the present invention; the second container is shown on the bottom with thermal energy storage material located in the second container sidewall; a first container recess forms a shoulder onto which the second container can be positioned.
Figure 13:
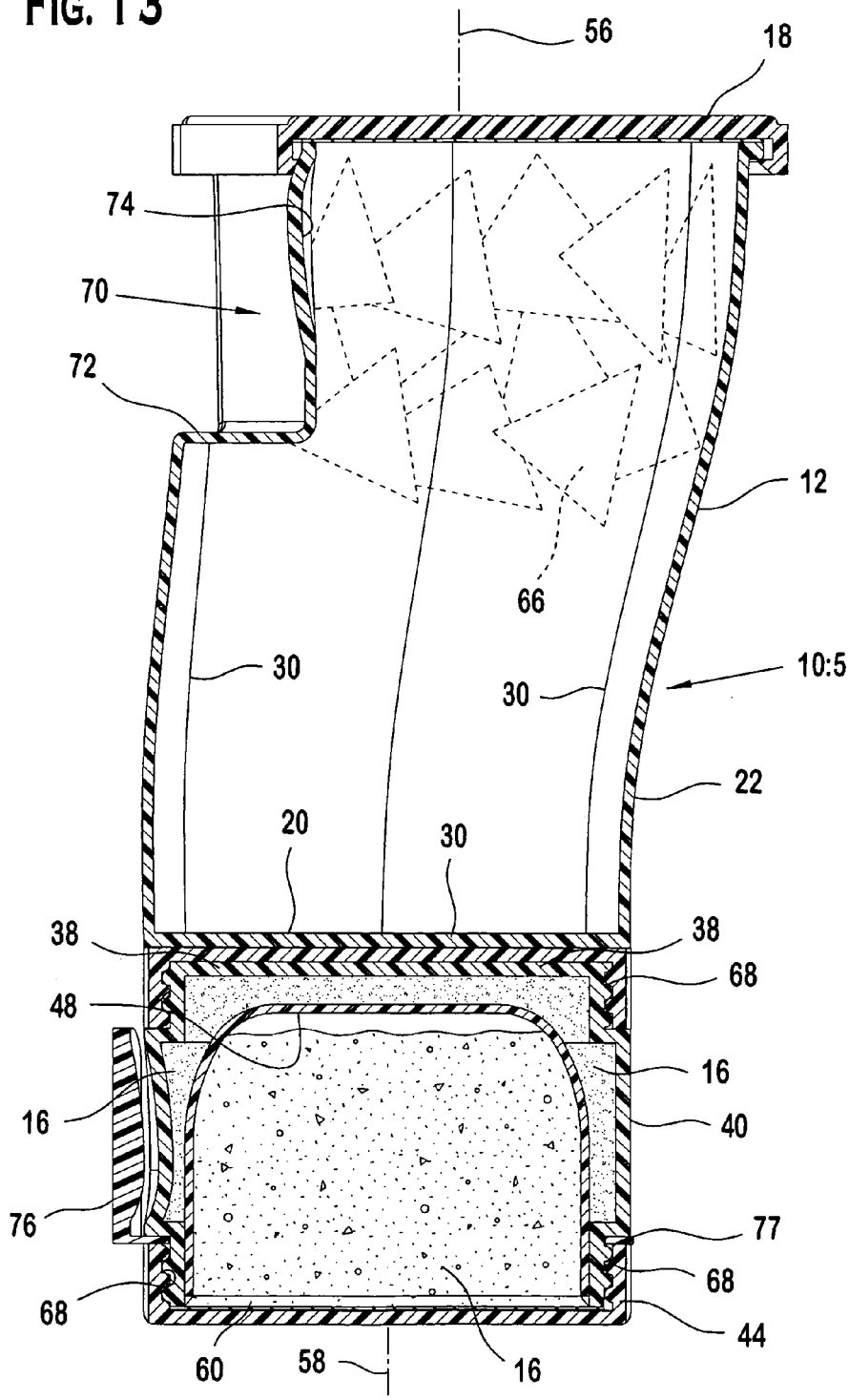
Figure 14:
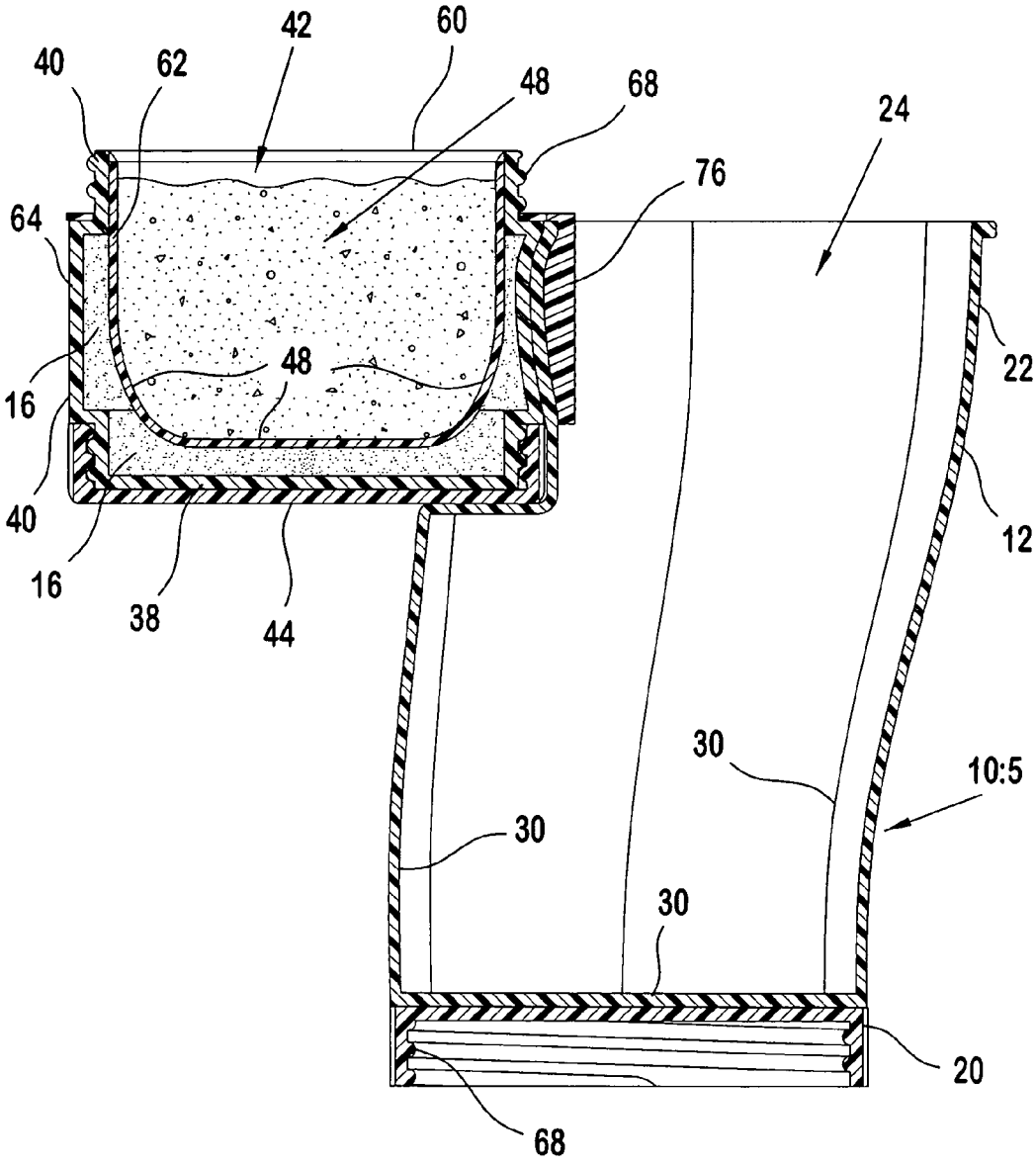
FIG. 14 is a cross sectional view of the two part container of FIG. 12 as taken along the line 14-14 of FIG. 12 illustrating the first and second containers in the second position with the first and second container mouths located generally side-by-side.
Figure 15:
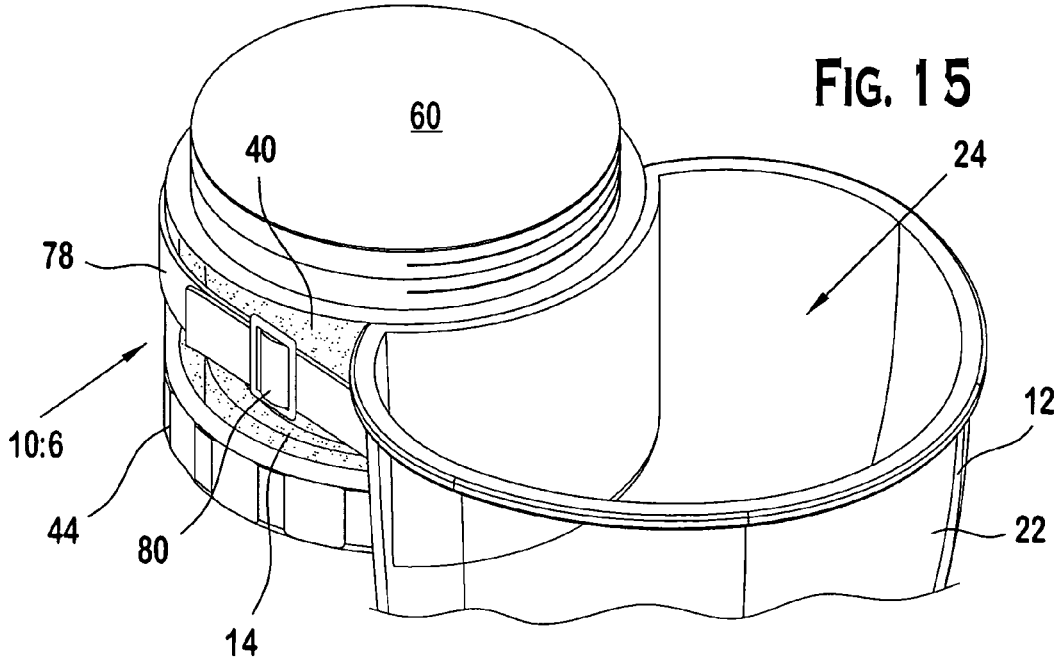

The two part container 10:5 includes first and second containers 12, 14 that can be engaged in either of a first position (best illustrated in FIG. 13) or a second position (best illustrated in FIG. 14). The first container sidewall 22 preferably, but not necessarily, defines a recess 70 that is shaped to form a shoulder 72. Referring to FIGS. 7 and 13, the recess 70 is preferably located proximate to the first container mouth 24. The shoulder 72 is preferably generally parallel to the first container base 20 and the recess 74 is generally arcuate to form a concave groove in the first container 12. As shown in FIGS. 10 and 11 the recess 70 is preferably shaped to correspond to the outer later surface of the second container 14. It is preferred that the first container sidewall is generally translucent.

It is also preferred that the second container 14 include inner and outer panels 62, 64. The outer panel 64 of the second container 14 can be generally translucent so that the second container 14 generally has a color of the thermal energy storage material 16.

When the first and second containers 12, 14 are detachably engaged in the first position, the first and second containers are located end-to-end with the first and second bases 20, 38 in a generally facing orientation to form-the two part container. Referring to FIG. 13, it is preferred that the first and second containers are connected by at least one thread 68. However, those of ordinary skill in the art will appreciate from this disclosure that the first and second containers 12, 14 can be connected by any suitable means without departing from the scope of the present invention. For example, the first and second containers 12, 14 can be connected via a twist lock, snap fit, or any other suitable connection.

Referring still to FIG. 13, when the first and second containers are in the first position, the first and second container mouths 24, 42 are preferably on generally opposing sides of the two part container 10:5 when the first and second containers 12, 14 are in the attached position. However, the first and second container mouths 24, 42 can both be oriented in the same direction (i.e., both face upwardly) when the first and second containers 12, 14 are in the first position without departing from the scope of the present invention.

Figure 12:
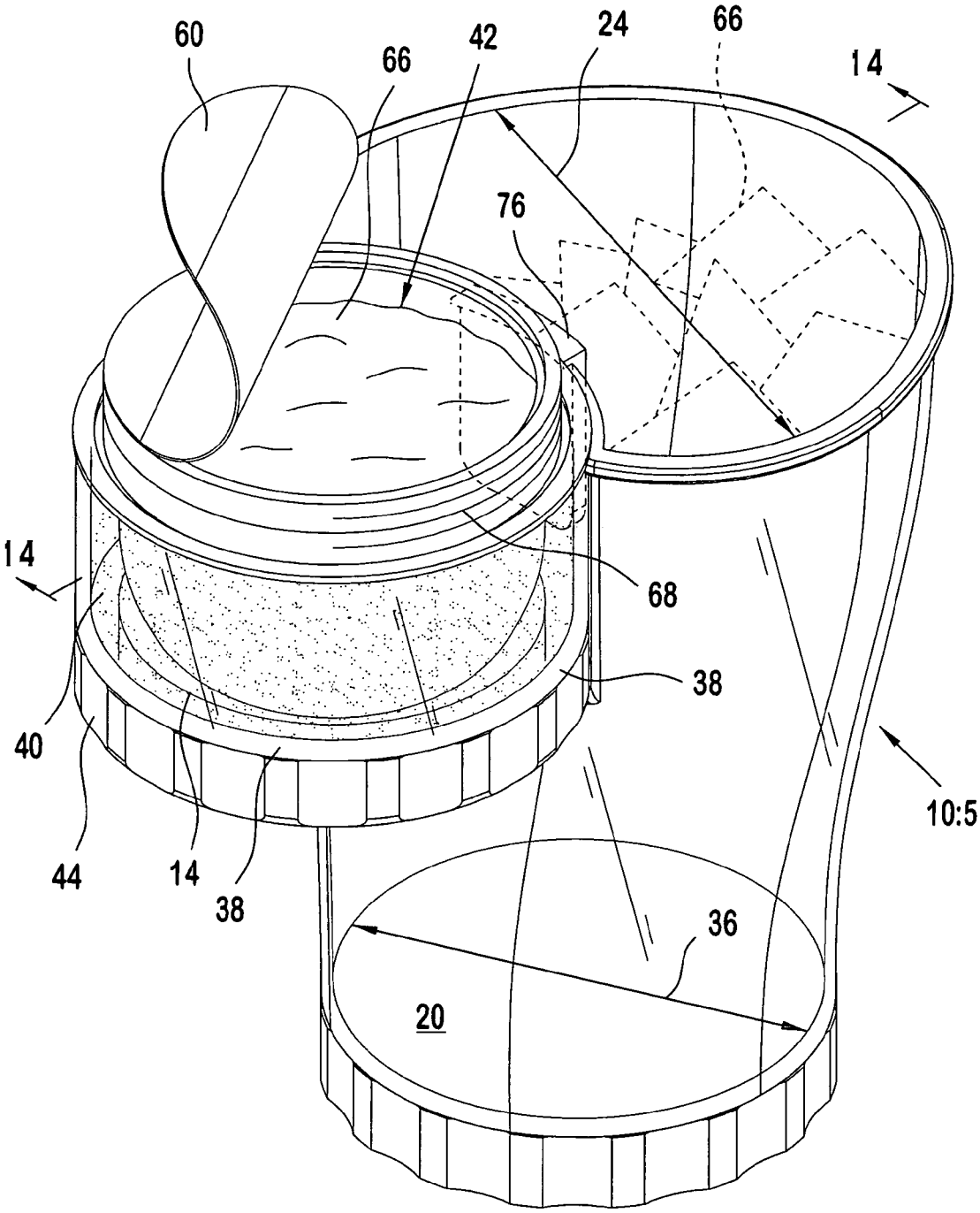
FIG. 12 is a perspective view of the two part container of FIG. 7 with the first and second containers located with the first and second mouths side-by-side in the second position; the separate seal on the second container is preferably removed after the first and second containers are in the side-by-side orientation; the portion of the first container that depends downwardly past the bottom of the second container makes a convenient gripping surface for carrying the two part container.

When the first and second containers 12, 14 are detachably engaged in the second position, the first and second containers are detachably engaged in the second position with the first and second container mouths 24, 42 located generally side-by-side, as shown in FIGS. 12 and 14. The term "generally side-by-side", as used in the claims and in the corresponding portions of the specification, does not require precise coplanar orientation of the mouths 24, 42. As such, some height differentiation between the mouths 24, 42 will not prevent the first and second container mouths 24, 42 from being considered side-by-side.

Referring to FIG. 10, the second container 14 may include a clip 76 for securing the second container 14 to the first container 12. The clip 76 preferably extends along a portion of the perimeter of the second container 14 in a spaced apart fashion. The clip 76 can be attached to the second container 14 via a ring 77. The ring 77 preferably extends over the second container mouth 42 to secure the second container 14 in position, while the first and second containers 12, 14 are in the second position. The recess 70 preferably includes an indentation 74 that allows the clip 76 to make a snap fit connection with the first container 12.

As best shown in FIG. 14, when the first and second containers 12, 14 are in eh second position, the first container recess 70 can support a lower edge of the second container 14, while the clip 76 can support an upper end of the second container 14. However, those of ordinary skill in the art will appreciate from this disclosure that many alternative methods can be used to secure the second container 14 to the first container 12 in the second position. For example, referring to FIG. 15, at least one strap 78 can be used to secure the second container 14 to the first container 12. While the illustrated strap 78 is affixed to the first container 12, the strap 78 can also extend around the first container 12 without departing from the scope of the present invention. When the first and second containers 12, 14 are in the first position, the strap 78 can be used to carry the two part container 10:6. The strap is secured with a buckle 80, but can be secured with any known suitable means, such as buttons, snaps, fasteners, hook and loop material, and the like.

Figure 16:
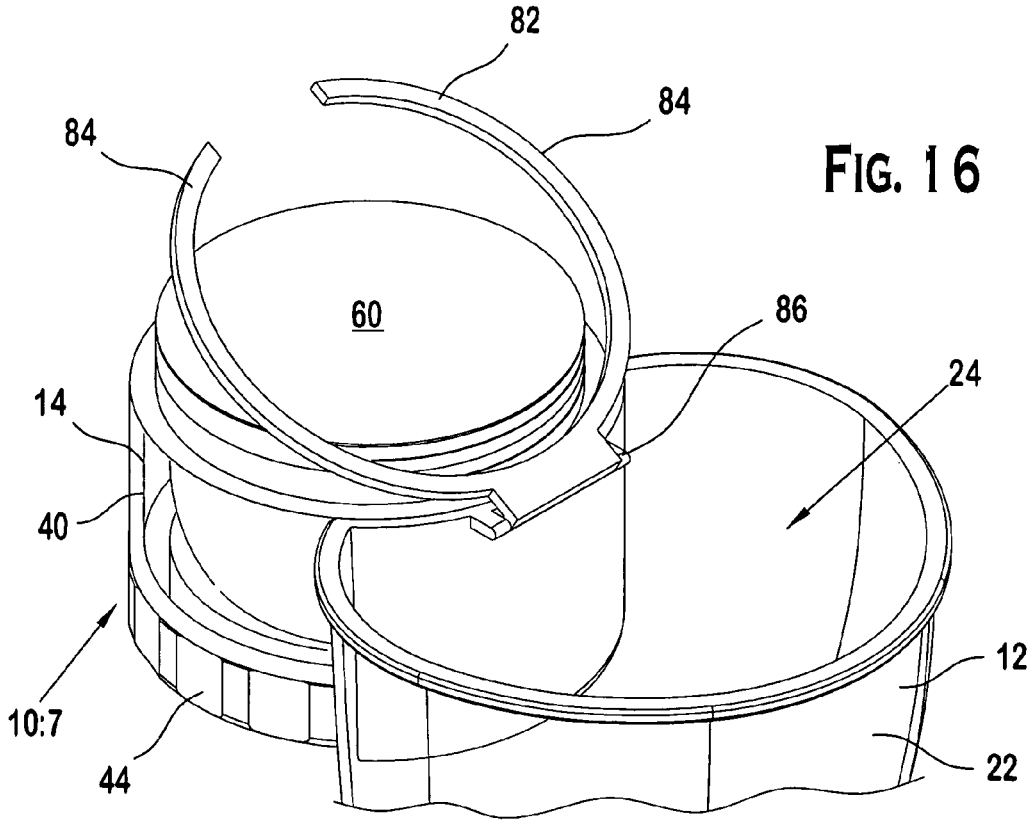
FIG. 16 is a partial, perspective view of a seventh preferred embodiment of the two part container of the present invention illustrating at a flexible claw for securing the second container to the first container; the flexible claw preferably includes two curved members that can form a friction fit, or interference fit, with the second container; the base of the flexible claw is preferably located within the first container mouth and connected to the first container via a hinge.

Referring to FIG. 16, the second container 14 can be secured to the first container 12 using a flexible claw 82. The flexible claw is preferably hinged 86 to the first container 12 proximate to the first container mouth 24. The claw is preferably deformable enough to create an interference friction fit with the second container 14 and may be formed by opposing curved members 84. When the lid 18 is removed from the first container 12, the flexible claw 82 can be rotated upwardly and outwardly from the first container 12 to bring the curved members 84 into engagement with the second container 14. When the first and second containers 12, 14 are in the second position, the flexible members 84 can secure the second container 14 to the first container 12 with the second container 14 partially located on the shoulder 72 of the first container 12.

Figure 17:
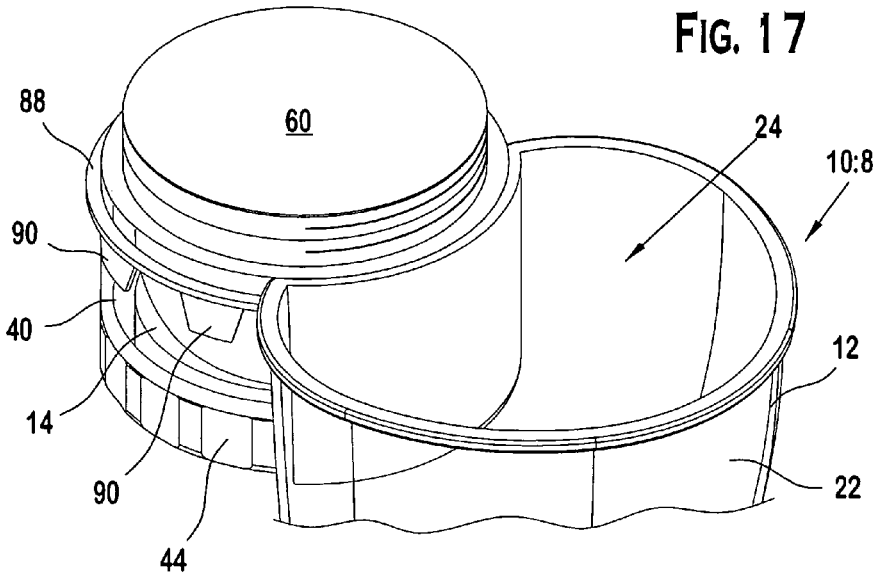
FIG. 17 is a partial, perspective view of an eighth preferred embodiment of the two part container of the present invention illustrating a retaining ring securing the second container to the first container; the retaining ring may include tabs that may be flexible or deformable.

Referring to FIG. 17, a retaining ring 88 can be positioned on the first container sidewall 22. When the first and second containers 12, 14 are in the second position, the retaining ring 88 can secure the second container 14 to the first container 12. The second retaining ring 88 may include flexible tabs 90 thereon to increase the friction fit between the second container 14 and the retaining ring 88. The tabs 90 also allow the retaining ring to be used with varying sized secondary containers.

Figure 18:
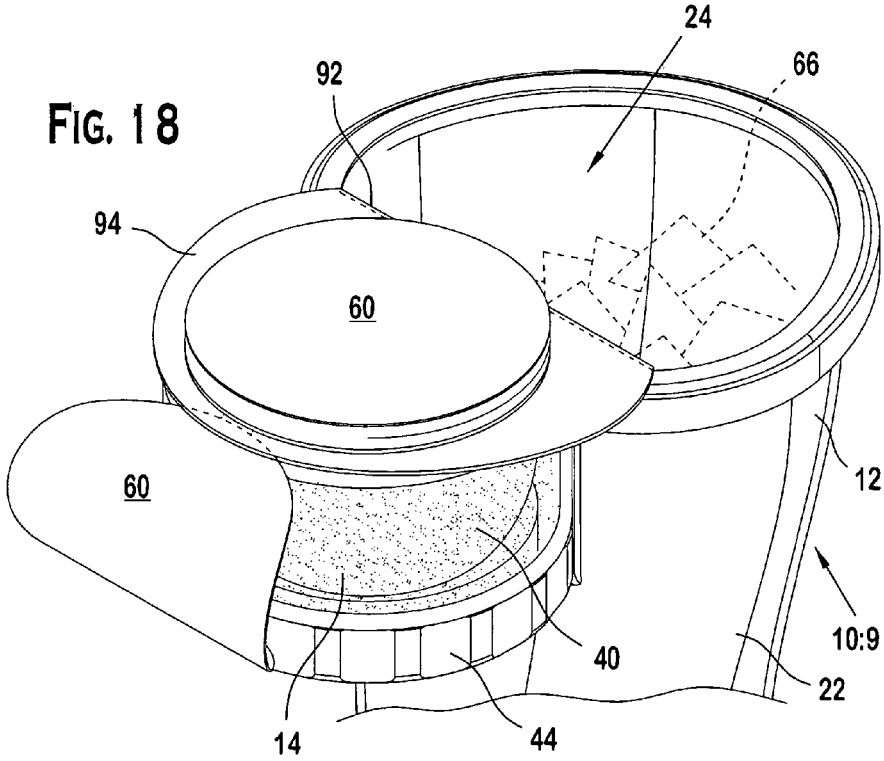
FIG. 18 is a partial, perspective view of a ninth preferred embodiment of the two part container of the present invention illustrating an inner lid securing the second container to the first container; the inner lid is preferably rotateable about a hinge located proximate the first container mouth; a seal (e.g., a foil or polymer seal) is preferably attached to the inner lid so that removal of the seal causes the inner lid to rotate into position to engage the second container.

Referring to FIG. 18, the first container 12 may include an inner lid 94 that is connected to the first container 12 via a hinge 92. The inner lid 94 can be rotated outwards to fit over the second container 14 to hold the second container 14 in position. Additionally, a seal (e.g., a foil or polymer seal) can be positioned over the inner lid 94 and attached to the inner lid 94 so that when the foil seal is removed, the inner lid is pulled generally into position to secure the second container 14.

Referring to FIGS. 7-14, one embodiment of the present invention works as follows. The two part container 10:5 is transported with foodstuffs 66 in the first and second foodstuff receiving cavities 30, 48. For example, cookies and milk, cereal and milk, chips and dip, or any other combination of foods can be separately carried in the two part container 10:5. When thermal energy storage material 16 is used with one or both of the first and second containers 12, 14, then the associated foodstuffs 66 can be maintained in a cooled or heated condition. Thermal energy storage material 16 can be eliminated from any of the two part containers without departing from the scope of the present invention.

Figure 8:
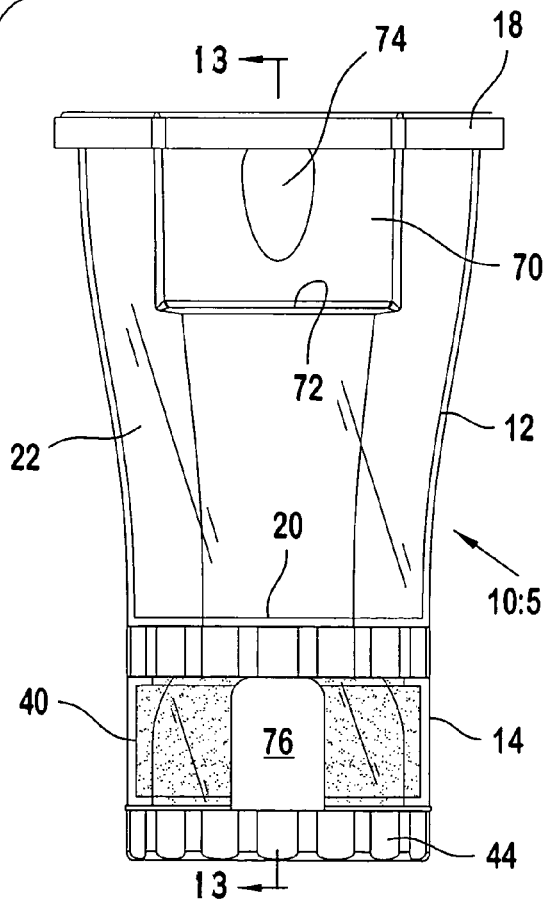
FIG. 8 is an elevational view of the two part container of FIG. 7 illustrating the first and second containers engaged in the first position.
Figure 9:
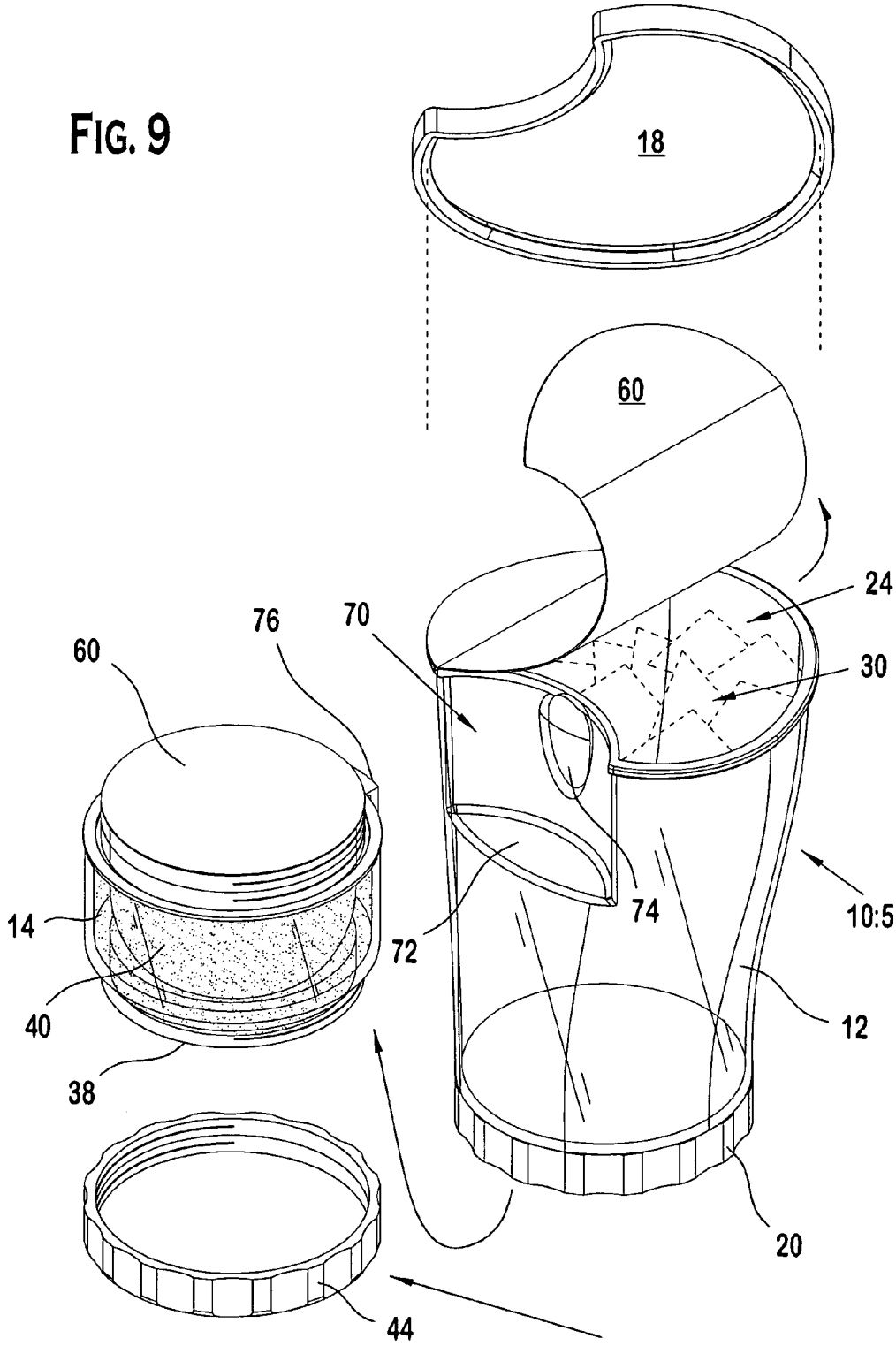
FIG. 9 is an exploded view of the two part container of FIG. 7; the second container has been detached from the first container and turned over so that the first and second container mouths are generally oriented in the same direction; the end cap that covered the mouth of the second container has been removed for attaching over the second container base; the clip is oriented to facilitate insertion of the second container into a first container recess while the clip engages an upper portion of the first container sidewall; a seal has been removed from the first container to allow insertion of a portion of the clip into the first container; a separate seal is ready to be removed from the second container.

Referring specifically to FIGS. 8 and 9, when consumption of foodstuffs is desired, the second container 12 is detached from the first container. The end cap 44 can be removed from the second container mouth 42 and secured to the second container base 38. If a seal 60 covers the first container mouth 24, then the seal 60 can be removed. Referring to FIG. 10, then the second container is positioned above the shoulder 72 with the clip aligned with the first container sidewall 22.

Referring to FIG. 14, the second container 14 can be moved downwardly to engage the clip 76 with the first container sidewall 22 and to seat a portion of the second container 14 on the shoulder 72. Referring to FIG. 13, the first container sidewall includes an indentation 74 to allow a snap fit between the clip 76 and the first container 12. A foldable spoon or other utensil can be included in either the first or second containers 12, 14.

When the first and second containers 12, 14 are in the first position, the two part container 10:5-10:9 is well suited for transport and easy carrying. When the two part container 10:5-10:9 is to be held in a single hand while eating the foodstuffs 66 therein, the first and second containers 12, 14 are positionable in the second position.

While various shapes, configurations, uses, and features have been described above and are shown in the drawings for the various embodiments of the present invention, those of ordinary skill in the art will appreciate from this disclosure that any combination of the above features can be used without departing from the scope of the present invention. Accordingly, it is recognized by those skilled in the art that changes may be made to the above described embodiments of the invention without departing from the broad inventive concept thereof. It is understood, therefore, that this invention is not limited to the particular embodiments disclosed, but is intended to cover all modifications which are within the spirit and scope of the invention as defined by the appended claims and/or shown in the attached drawings.

We claim:

1. A two part container adapted to separately hold consumable foodstuffs, comprising:

a first container, comprising:

a first container base; and a first container sidewall extending from the first container base to define a single first container mouth, the first container sidewall and the first container base defining a first foodstuff receiving cavity, and the first container mouth being open to the first foodstuff receiving cavity;

a second container comprising:

a second container base; and a second container sidewall extending from the second container base to define a single second container mouth, the second container sidewall being formed by inner and outer panels, the inner panel and the second container base defining a second foodstuff receiving cavity, the outer panel being spaced from the inner panel to define a chamber therebetween, wherein thermal energy storage material is received in the chamber;

wherein the first and second containers are detachably engageable in first and second positions, when the first and second containers are detachably engaged in the first position, the first and second containers are located end-to-end with the first and second container bases in a generally adjacent, facing orientation, and the first and second container mouths are oriented on generally opposing sides of the two part container, when the first and second containers are detachably engaged in the second position, the first and second container mouths are located generally side-by-side, the two part container being adapted to separately hold consumable foodstuffs in the first and second containers regardless of whether the first and second containers are engaged in the first or second position.

2. The two part container of claim 1, wherein the first and second containers are detachably engageable in the first position via a threaded connection between the first and second container bases.

3. The two part container of claim 2, wherein, when the first and second containers are attached in the second position, the second container is secured to the first container via a clip.

4. The two part container of claim 1, wherein the first container sidewall defines a recess proximate to the first container mouth, the recess defining a shoulder, when the first and second containers are attached in the second position, the second container is partially located on the shoulder of the first container.

5. The two part container of claim 4, further comprising a clip positioned on the second container, wherein when the first and second containers are in the second position, the clip is engaged with the first container sidewall and the second container is partially located on the shoulder of the first container.

6. The two part container of claim 1, further comprising a foldable spoon locatable in at least one of the first and second containers.

7. A two part container adapted to separately hold consumable foodstuffs, comprising:

a first container, comprising:

a first container base; and a first container sidewall extending from the first container base to define a single first container mouth, the first container sidewall and the first container base defining a first foodstuff receiving cavity, and the first container mouth being open to the first foodstuff receiving cavity;

a second container comprising:

a second container base; and a second container sidewall extending from the second container base to define a single second container mouth, the second container base and the second container sidewall defining a second foodstuff receiving cavity;

wherein the first and second containers are detachably engageable in first and second positions, when the first and second containers are detachably engaged in the first position, the first and second containers are located end-to-end with the first and second container bases in a generally adjacent, facing orientation, and the first and second container mouths are oriented on generally opposing sides of the two part container, when the first and second containers are detachably engaged in the second position the first and second container mouths are located generally side-by-side, the two part container being adapted to separately hold consumable foodstuffs in the first and second containers regardless of whether the first and second containers are engaged in the first or second position.

8. The two part container of claim 7, further comprising a clip positioned on the second container, wherein when the first and second containers are in the second position, the clip is engaged with the first container sidewall to secure the first and second containers together.

9. The two part container of claim 7, further comprising thermal energy storage material disposed in the second container sidewall.

10. A two part container adapted to separately hold consumable foodstuffs, comprising:

a first container, comprising:

a first container base; and a first container sidewall extending from the first container base to define a single first container mouth, the first container sidewall and the first container base defining a first foodstuff receiving cavity, wherein the first container sidewall defines a recess proximate to the first container mouth, the recess forming a shoulder, and the first container mouth being open to the first foodstuff receiving cavity;

a second container comprising:

a second container base; and a second container sidewall extending from the second container base to define a single second container mouth, the second container base and the second container sidewall defining a second foodstuff receiving cavity; and a clip positioned on the second container;

wherein the first and second containers are detachably engageable in first and second positions, when the first and second containers are detachably engaged in the first position, the first and second containers are located end-to-end with the first and second container bases in a generally adjacent, facing orientation, and the first and second container mouths are oriented on generally opposing sides of the two part container, when the first and second containers are detachably engaged in the second position the first and second container mouths are located generally side-by-side and the clip is engaged with the first container sidewall and the second container is partially located on the shoulder of the first container, the two part container being adapted to separately hold consumable foodstuffs in the first and second containers regardless of whether the first and second containers are engaged in the first or second position.

11. The two part container of claim 10, further comprising thermal energy storage material disposed in the second container sidewall.

12. The two part container of claim 7, wherein the first and second containers are detachably engageable in the first position via a threaded connection between the first and second container bases.

13. The two part container of claim 10, wherein the first and second containers are detachably engageable in the first position via a threaded connection between the first and second container bases.

14. The two part container of claim 10, wherein the recess is a concave groove in the first container.

15. The two part container of claim 10, wherein the second container sidewall has a substantially cylindrical shape.

16. The two part container of claim 10, wherein the recess has a complimentary geometry to the second container sidewall.

17. The two part container of claim 10, wherein a portion of the first container sidewall adjacent to the first container mouth extends beyond the first container base in a first direction and the second container, when engaged in the second position, extends beyond the first container base in a second direction substantially opposite the first direction, thereby substantially balancing the two part container when engaged in the second position.

18. The two part container of claim 17 wherein a portion of the second container, when engaged in the second position, is positioned directly above the first container base.

19. The two part container of claim 17, wherein the first container further comprises:

a first lid adapted and configured to removably seal the first container mouth.

20. The two part container of claim 17, wherein the second container further comprises:

a second lid adapted and configured to removably seal the second container mouth.

21. The two part container of claim 1, wherein the first container further comprises:

a first lid adapted and configured to removably seal the first container mouth.

22. The two part container of claim 1, wherein the second container further comprises:

a second lid adapted and configured to removably seal the second container mouth.

23. The two part container of claim 7, wherein the first container further comprises:

a first lid adapted and configured to removably seal the first container mouth.

24. The two part container of claim 7, wherein the second container further comprises:

a second lid adapted and configured to removably seal the second container mouth.

* * * * *